US011491363B2

(12) United States Patent
Teeter Leier et al.

(10) Patent No.: US 11,491,363 B2
(45) Date of Patent: Nov. 8, 2022

(54) EXERCISE METHODS AND APPARATUS

(71) Applicant: Expectations, LLC, Bonney Lake, WA (US)

(72) Inventors: Rylie Teeter Leier, Lake Tapps, WA (US); Nicholas M. Soller, Edgewood, WA (US); Christopher H. Leier, Lake Tapps, WA (US); Mark A. Krull, New Braunfels, TX (US); Stephen P. Ihli, Santa Monica, CA (US)

(73) Assignee: Expectations, LLC, Bonney Lake, WA (US)

( * ) Notice: Subject to any disclaimer, the term of this patent is extended or adjusted under 35 U.S.C. 154(b) by 344 days.

(21) Appl. No.: 16/788,492

(22) Filed: Feb. 12, 2020

(65) Prior Publication Data

US 2020/0289872 A1 Sep. 17, 2020

Related U.S. Application Data

(60) Provisional application No. 62/818,537, filed on Mar. 14, 2019.

(51) Int. Cl.

| | |
|---|---|
| ***A63B 21/00*** | (2006.01) |
| ***A63B 21/015*** | (2006.01) |
| ***A63B 71/06*** | (2006.01) |

(52) U.S. Cl.

CPC ..... *A63B 21/153* (2013.01); *A63B 21/00069* (2013.01); *A63B 21/015* (2013.01); (Continued)

(58) Field of Classification Search

CPC ..... A63B 21/00058; A63B 21/00069; A63B 21/0051; A63B 21/0052; A63B 21/0056; A63B 21/0057; A63B 21/012; A63B 21/0125; A63B 21/015; A63B 21/018; A63B 21/02; A63B 21/022; A63B 21/023; A63B 21/025; A63B 21/0407; (Continued)

(56) References Cited

U.S. PATENT DOCUMENTS 1,390,095 A 9/1921 Dettinger et al.
2,959,414 A * 11/1960 Saltz ..... A63B 21/4035 242/379.2

(Continued)

FOREIGN PATENT DOCUMENTS

| | | |
|---|---|---|
| CN | 203329277 U | 12/2013 |
| CN | 207286554 U | 5/2018 |
| TW | 200843814 A | 11/2008 |

OTHER PUBLICATIONS

Taiwanese Search Report for Patent Appln. No. 109108080; 2 pages, dated Jul. 7, 2021.

*Primary Examiner* — Gary D Urbiel Goldner
(74) *Attorney, Agent, or Firm* — Dicke, Billig & Czaja, PLLC

(57) ABSTRACT

An exercise apparatus includes a resistance device including left and right sheaves and associated rewind mechanisms. Left and right cords are routed from the sheaves through left and right swivel pulleys to left and right force receiving members. A person stands on a foot platform and exercises by using her arms and/or her legs to pull the cords from the sheaves. The person may stabilize herself by placing one or both hands on handlebars when those hands are not involved in the pulling activity.

24 Claims, 11 Drawing Sheets

(52) U.S. Cl.
CPC ..... *A63B 21/154* (2013.01); *A63B 21/4034* (2015.10); *A63B 21/4035* (2015.10); *A63B 71/0622* (2013.01); *A63B 2225/685* (2013.01)

(58) Field of Classification Search
CPC ..... A63B 21/0414; A63B 21/0421; A63B 21/0428; A63B 21/0435; A63B 21/0442; A63B 21/045; A63B 21/0455; A63B 21/15; A63B 21/151; A63B 21/153; A63B 21/154; A63B 21/156; A63B 21/157; A63B 21/22; A63B 21/225; A63B 21/227; A63B 21/4027; A63B 21/4033; A63B 21/4034; A63B 21/4035; A63B 21/4049; A63B 23/04; A63B 23/12; A63B 23/1209; A63B 71/0054; A63B 71/0619; A63B 71/0622; A63B 2071/0063; A63B 2071/0072; A63B 2071/009; A63B 2071/0694; A63B 2210/00; A63B 2210/50; A63B 2225/09; A63B 2225/093; A63B 2225/68; A63B 2225/685
See application file for complete search history.

(56) References Cited

U.S. PATENT DOCUMENTS 3,387,493 A * 6/1968 Strittmatter ..... A61B 5/221 73/862.471
3,704,886 A * 12/1972 Kay ..... A63B 21/00069 482/62
3,885,789 A * 5/1975 Deluty ..... A63B 21/00069 242/147 R
3,995,853 A * 12/1976 Deluty ..... A63B 21/00069 482/123
4,010,948 A * 3/1977 Deluty ..... A63B 21/153 188/65.3
4,114,875 A * 9/1978 Deluty ..... A63B 21/018 188/65.1
4,625,962 A 12/1986 Street
4,848,152 A * 7/1989 Pratt, Jr. ..... A63B 21/4005 482/901
4,912,638 A * 3/1990 Pratt, Jr. ..... A63B 21/4005 600/595
4,948,119 A 8/1990 Robertson, Jr.
5,271,416 A * 12/1993 Lepley ..... A63B 21/22 600/595
5,324,243 A 6/1994 Wilkinson
5,409,435 A * 4/1995 Daniels ..... F16D 57/002 482/901
5,755,646 A 5/1998 Chu
6,726,607 B1 4/2004 Ihli
7,087,001 B1 8/2006 Ihli
7,976,445 B2 * 7/2011 Lalaoua ..... A63B 21/4005 482/904
8,465,401 B1 6/2013 Ihli et al.
8,523,745 B1 9/2013 Ihli et al.
8,556,783 B1 10/2013 Ihli et al.
8,556,785 B1 10/2013 Ihli et al.
8,622,879 B1 1/2014 Ihli et al.
8,845,499 B1 * 9/2014 Boatwright ..... A63B 21/157 482/116
8,998,779 B1 4/2015 Ihli et al.
9,028,381 B2 * 5/2015 Mestemaker ..... A63B 21/154 482/130
9,498,666 B1 * 11/2016 Boatwright ..... A63B 21/152
9,700,753 B1 * 7/2017 Boatwright ..... A63B 24/0062
10,029,138 B1 * 7/2018 Boatwright ..... A63B 21/015
10,398,919 B2 * 9/2019 Krull ..... A63B 21/023
10,512,812 B2 * 12/2019 Krull ..... A63B 21/4043
2002/0016237 A1 * 2/2002 Schmidt ..... A63B 21/015 482/70
2002/0086779 A1 * 7/2002 Wilkinson ..... A63B 23/1263 482/118
2003/0153441 A1 * 8/2003 Berns ..... A63B 21/00069 482/124
2003/0211920 A1 * 11/2003 Mandel ..... A63B 21/015 482/115
2004/0043873 A1 * 3/2004 Wilkinson ..... A63B 21/16 482/52
2008/0287263 A1 11/2008 Cheng
2010/0144496 A1 * 6/2010 Schmidt ..... A63B 23/12 482/70
2011/0177923 A1 * 7/2011 Smith ..... A63B 21/222 482/110
2011/0294633 A1 12/2011 Esrick et al.
2014/0274609 A1 9/2014 Yeh
2015/0182773 A1 * 7/2015 Olson ..... A63B 23/03541 482/92
2018/0001128 A1 * 1/2018 Norris ..... A63B 21/0058
2018/0021617 A1 1/2018 Krull et al.
2018/0280753 A1 10/2018 Krull et al.
2019/0105526 A1 * 4/2019 Boatwright ..... A63B 21/06
2019/0160320 A1 * 5/2019 Lagree ..... A63B 21/153

* cited by examiner

EXERCISE METHODS AND APPARATUS

This application claims the benefit of U.S. Provisional Application No. 62/818,537, filed Mar. 14, 2019, which is incorporated herein by reference.

BACKGROUND

Embodiments of the present invention relate to manually operated exercise equipment and more specifically, to methods and apparatus for accommodating a person in a standing position and performing exercises by pulling at least one cord from an associated sheave.

A variety of exercise devices have been developed to resist exercise motion. Examples are disclosed in U.S. Pat. Nos. 6,726,607 and 7,087,001 to Ihli, U.S. Pat. Nos. 8,465,410, 8,523,745, 8,556,783, 8,556,785, and 8,622,879 to Ihli et al., and U.S. Patent Publication Nos. 20180021617 and 20180280753 in the name of Ihli et al., An object of the present invention is to provide improved exercise devices and methods of using same.

SUMMARY

One aspect of the present invention involves an exercise resistance device having a cord that is wrapped about a sheave. The cord is extracted from the sheave in response to an externally-supplied user force, and rewound onto the sheave when an internally-supplied spring force exceeds the user force. In one embodiment, left and right sheaves rotate about a fixed axis as corresponding left and right cords are pulled from the sheaves and subsequently allowed to rewind onto the sheaves. The cords are preferably routed through swiveling pulleys that swivel about respective axes that align with respective cords. The swivel pulleys are preferably disposed between the resistance device and a foot platform. A handlebar is preferably provided above the location of the resistance device so a person can brace herself with one or both hands while performing exercises (via the cords) with one or both legs. A holder is preferably mounted on the handlebar to hold one or both cords at a relatively higher elevation above the floor surface when not in use, allowing a person to readily grab the cords and perform exercises with one or both arms (via the cords) without bending over to take hold of the cords proximate the swivel pulleys.

Various features and/or advantages of the present invention will become apparent from the more detailed description that follows.

BRIEF DESCRIPTION OF THE DRAWINGS

With reference to the Figures of the Drawings, wherein like numerals represent like parts and assemblies throughout the several views.

DETAILED DESCRIPTION

Figure 1:
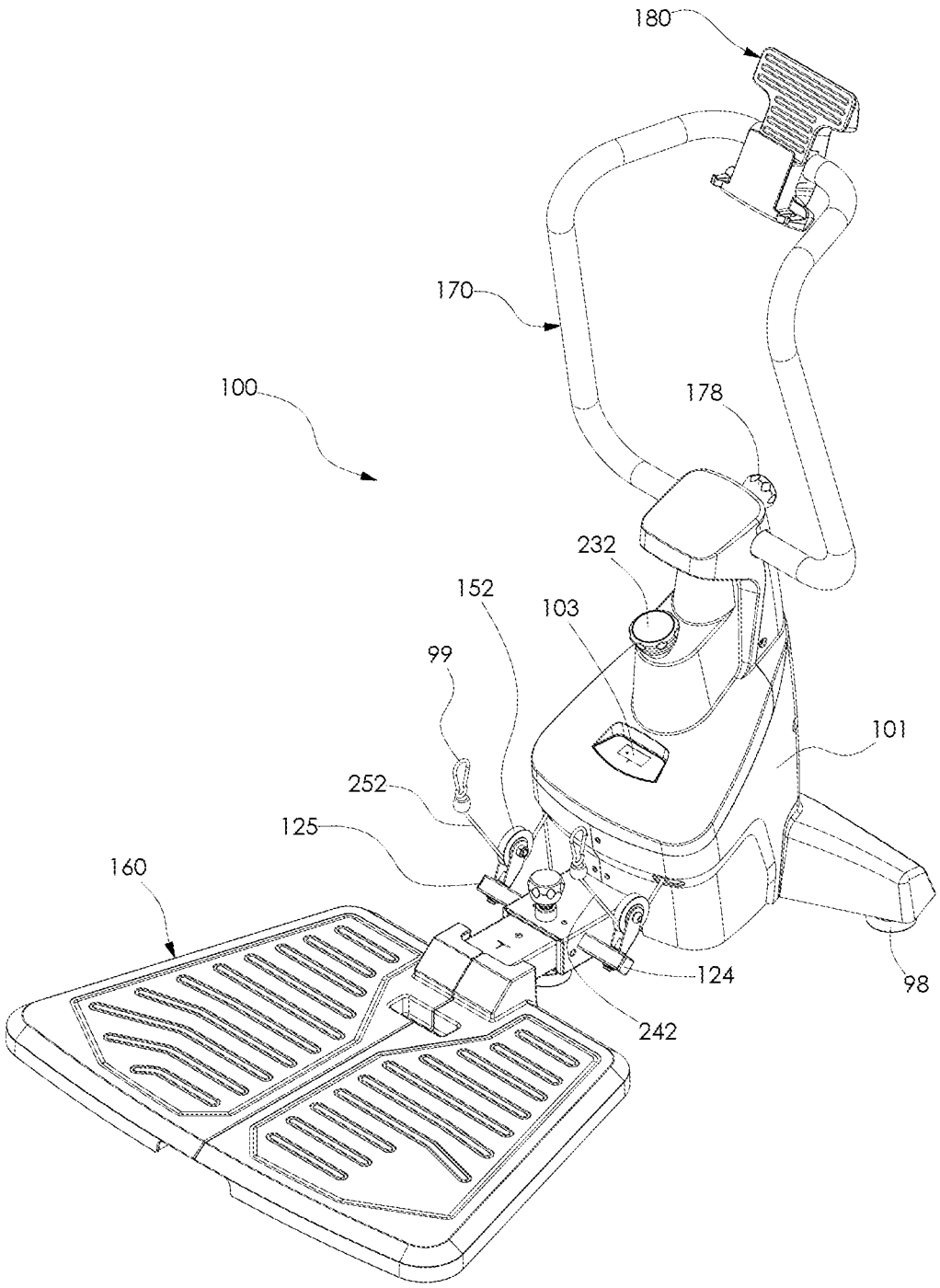
FIG. 1 is a perspective view of an embodiment exercise apparatus constructed according to the principles of the present invention.
Figure 2:
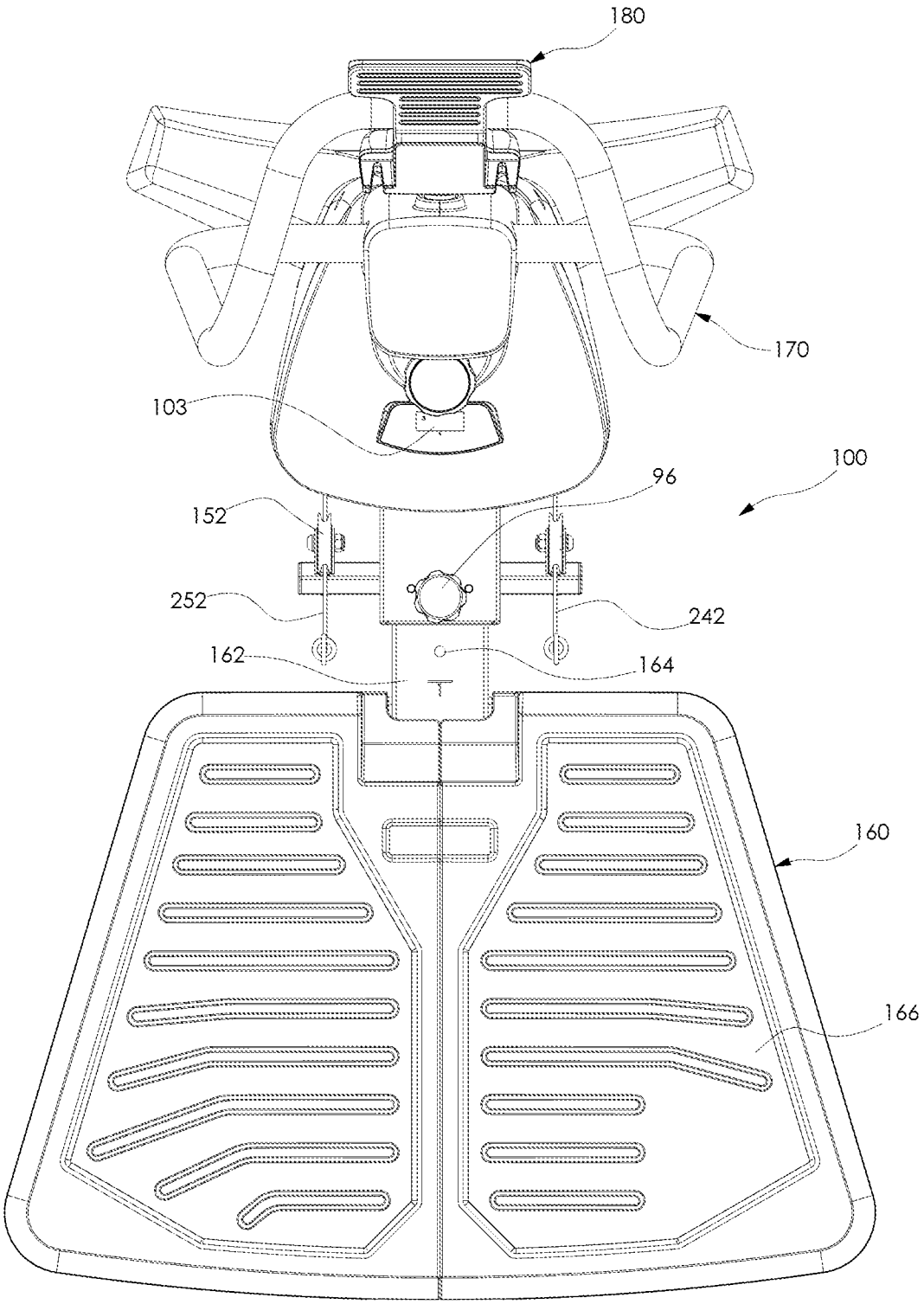
FIG. 2 is top view of the exercise apparatus of FIG. 1.
Figure 3:
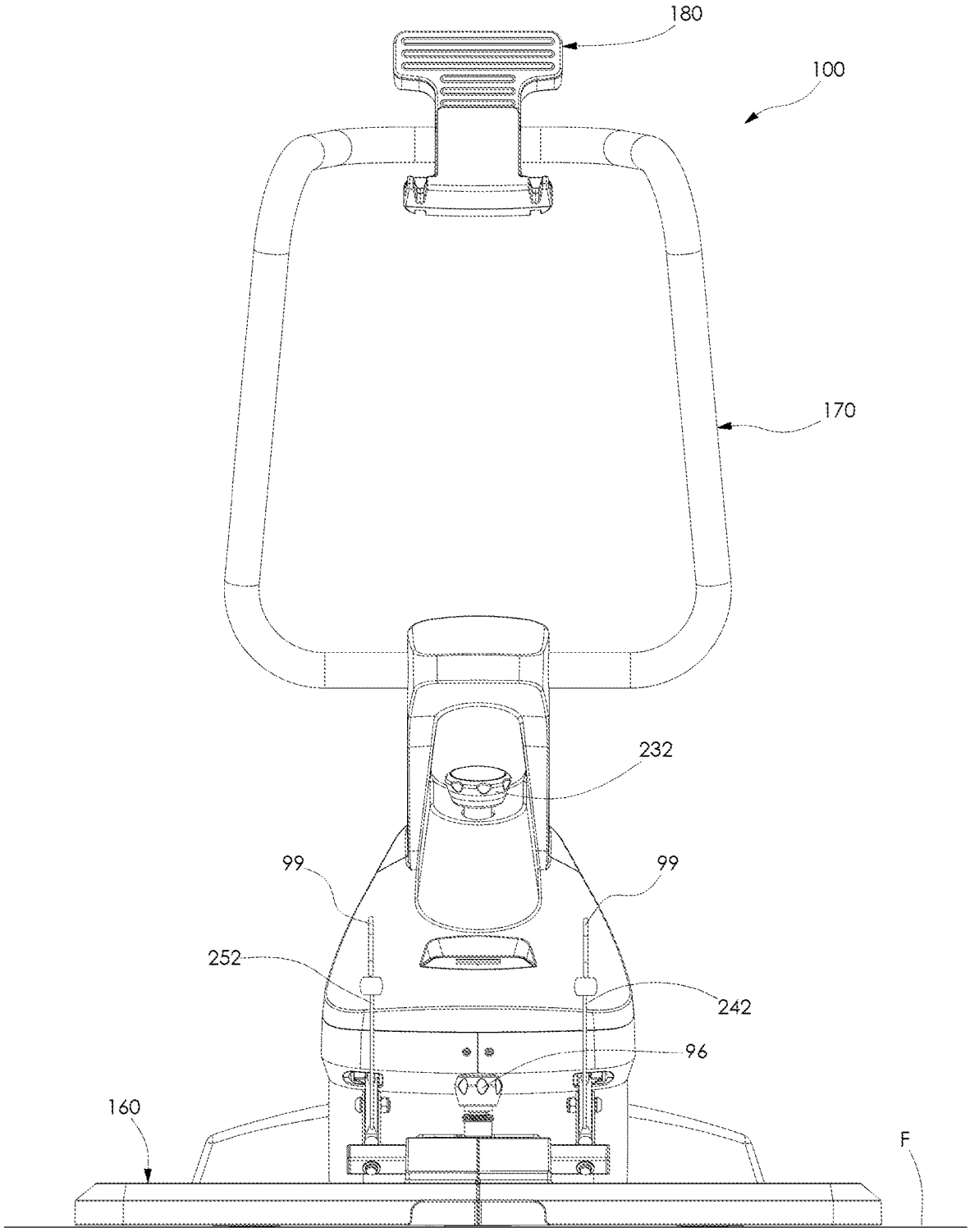
FIG. 3 is a rear end view of the exercise apparatus of FIG. 1.
Figure 4:
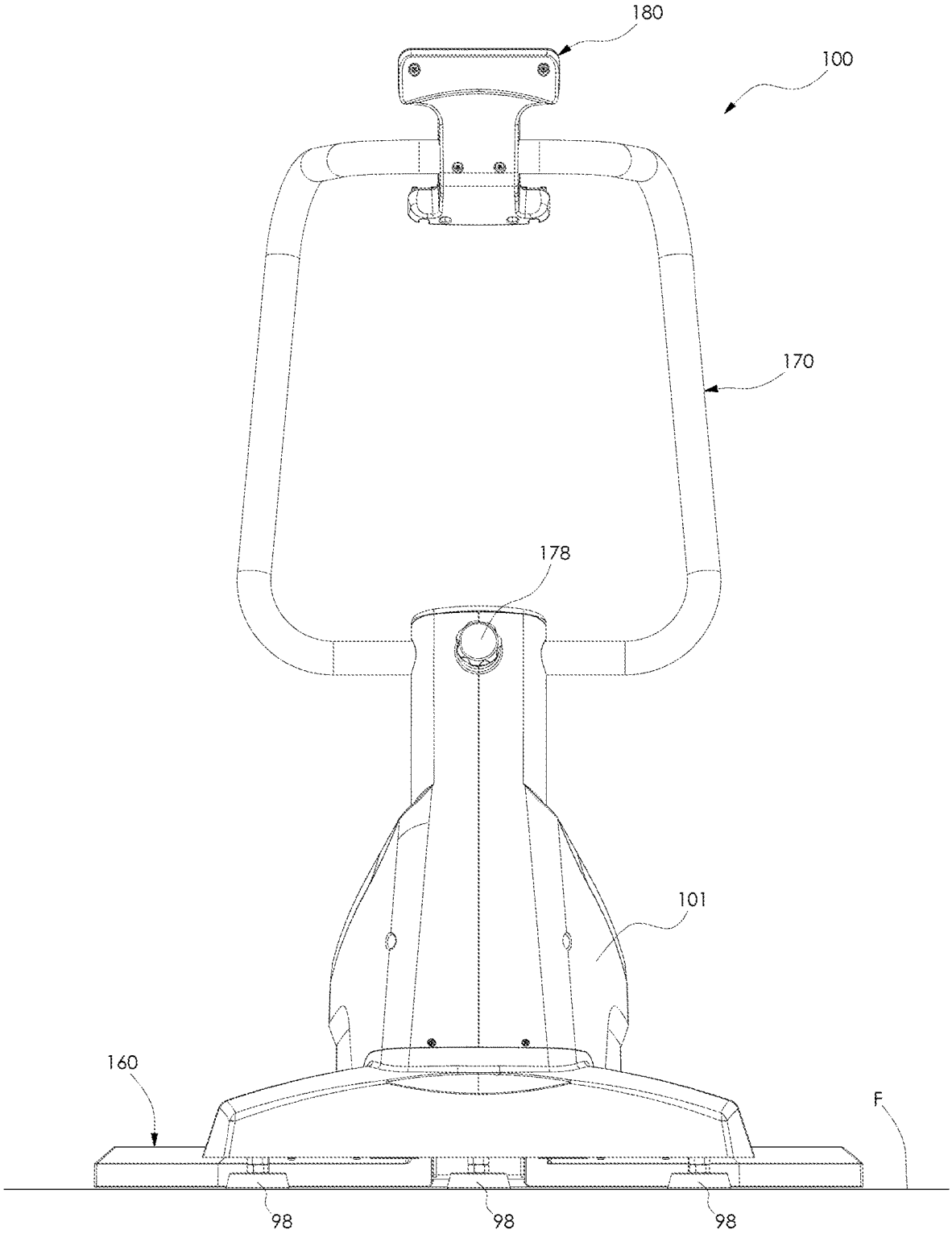
FIG. 4 is a front end view of the exercise apparatus of FIG. 1.

An embodiment exercise apparatus constructed according to the principles of the present invention is designated as 100 in FIGS. 1-4 and 5*a*-5*b*. The exercise apparatus 100 includes a first resistance device 200, which is already known in the art for use on certain exercise equipment. For examples, see U.S. Pat. No. 6,726,607 to Ihli, U.S. Pat. Nos. 8,465,401, 8,523,745, 8,556,783 and 8,998,779 to Ihli et al., and U.S. Patent Publication Nos. 20180021617 and 20180280753 in the name of Ihli et al., all of which are incorporated herein by reference to supplement this disclosure regarding the construction, features, and/or use of embodiments of the present invention.

The exercise apparatus 100 includes a frame or base 110 configured to occupy a stable operating position on an underlying horizontal floor surface F. The base 110 is constructed in a manner known in the art and preferably comprises square steel tubes and sheet metal brackets that are welded together to form a rigid frame 100 extending from a first or front end 112 to an opposite, second or rear end 114. Plastic shell members cooperate to form an enclosure or shroud 101 about the resistance device 200 and most of the base 110, and are secured to the base 110 be screws or other known means.

Since the resistance device 200 is known in the art, it will be described in only general terms with the understanding that additional details may be gleaned from the documents incorporated herein by reference. The resistance device 200 includes a shaft 210 rotatably mounted on the frame 110; a brake drum 220 keyed to the shaft 210; an adjustable brake assembly 230 mounted on the frame 110 and operatively connected to the brake drum 220, including a respective user-operated adjustment knob 232; a right sheave 240 and associated rewind spring, wherein the right sheave 240 is connected to the shaft 210 by a one-way clutch bearing, and the rewind spring (not shown) is interconnected between the frame 110 and the right sheave 240; and a mirror image left sheave (not shown) and associated rewind spring, wherein the left sheave is connected to the shaft 210 by a one-way clutch bearing, and the rewind spring (also not shown) is interconnected between the frame 110 and the left sheave.

A left cord 252 has a first end connected to the left sheave, an opposite second end connected to a carabiner 99 for attachment to a force receiving member (as further discussed below and in the incorporated references), and intermediate portions disposed therebetween, including a portion wrapped around the left sheave. Similarly, a right cord 242 has a first end connected to the right sheave 240, an opposite second end connected to a carabiner 99 for attachment to a force receiving member (as further discussed below and in the incorporated references), and intermediate portions disposed therebetween, including a portion wrapped around the right sheave 240. For ease of illustration, FIGS. 1-3 and 5*a* show each cord 242 and 252 in a partially extracted, unstable state, when in fact, the rewind springs would normally pull the carabiners 99 down against the pulleys 142 and 152.

The frame 110 includes a central tube or channel member 116 that extends longitudinally front to back and defines the rear end 114 of the frame 110. At least one front leg or tube is connected to a forward end of the central frame member 116 to define laterally extending left and right front leg segments. Floor engaging feet 98 of a type known in the art are secured to distal ends of the left and right front leg segments to engage an underlying horizontal floor surface F. Another foot 98 is secured to the center of the central frame member 116 proximate the rear end 114 to similarly engage the underlying horizontal floor surface F.

Proximate the rear end 114 of the frame 110, right and left tubes or arm members 124 and 125 extend laterally outward from respective sides of the frame. Left and right brackets 140 and 150 are rotatably mounted on respective members 124 and 125 for rotation about parallel respective bracket axes X. Right and left pulleys 142 and 152 are rotatably mounted on respective brackets 140 and 150 for rotation about respective pulley axes, which extend perpendicular to respective bracket axes X. Each cord 242 and 252 has an intermediate segment routed from a respective sheave to a respective pulley 142 or 152, and each such cord segment linearly aligns with a respective bracket axis X. As a result, each pulley 142 and 152 can pivot to the left or to the right without disrupting smooth and reliable passage and re-routing of a respective cord 242 or 252. Recognizing that the orientation of the cord segment will vary to an extent based on how much cord is wrapped around the sheave, it may be said that at some point between minimum extraction and maximum extraction, the cord segment linearly aligns with the bracket axis X, and/or the cord segment remains within five degrees of being co-linear with the bracket axis X throughout the range from minimum extraction to maximum extraction.

Each pulley 142 and 152 may be described as being positioned forward of the foot platform 160 and/or rearward of a respective sheave. Each pulley 142 and 152 also may be described as being positioned relatively higher than the foot platform 160 and/or relatively lower than the shaft 210 of the resistance device 200.

Figure 5A:
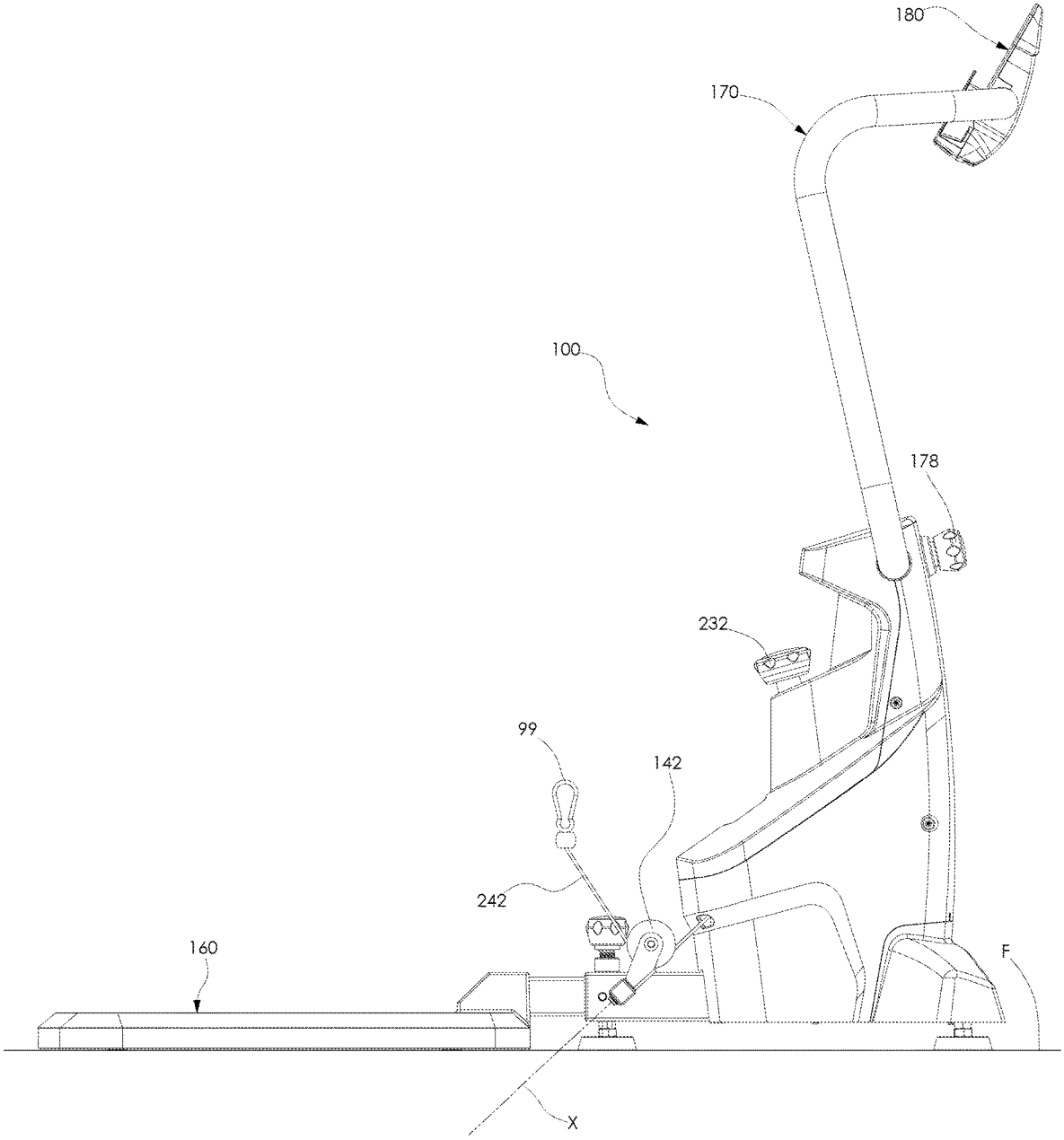
FIG. 5*a* is a right side view of the exercise apparatus shown in FIG. 1, the opposite, left side view being a mirror image thereof.
Figure 5B:
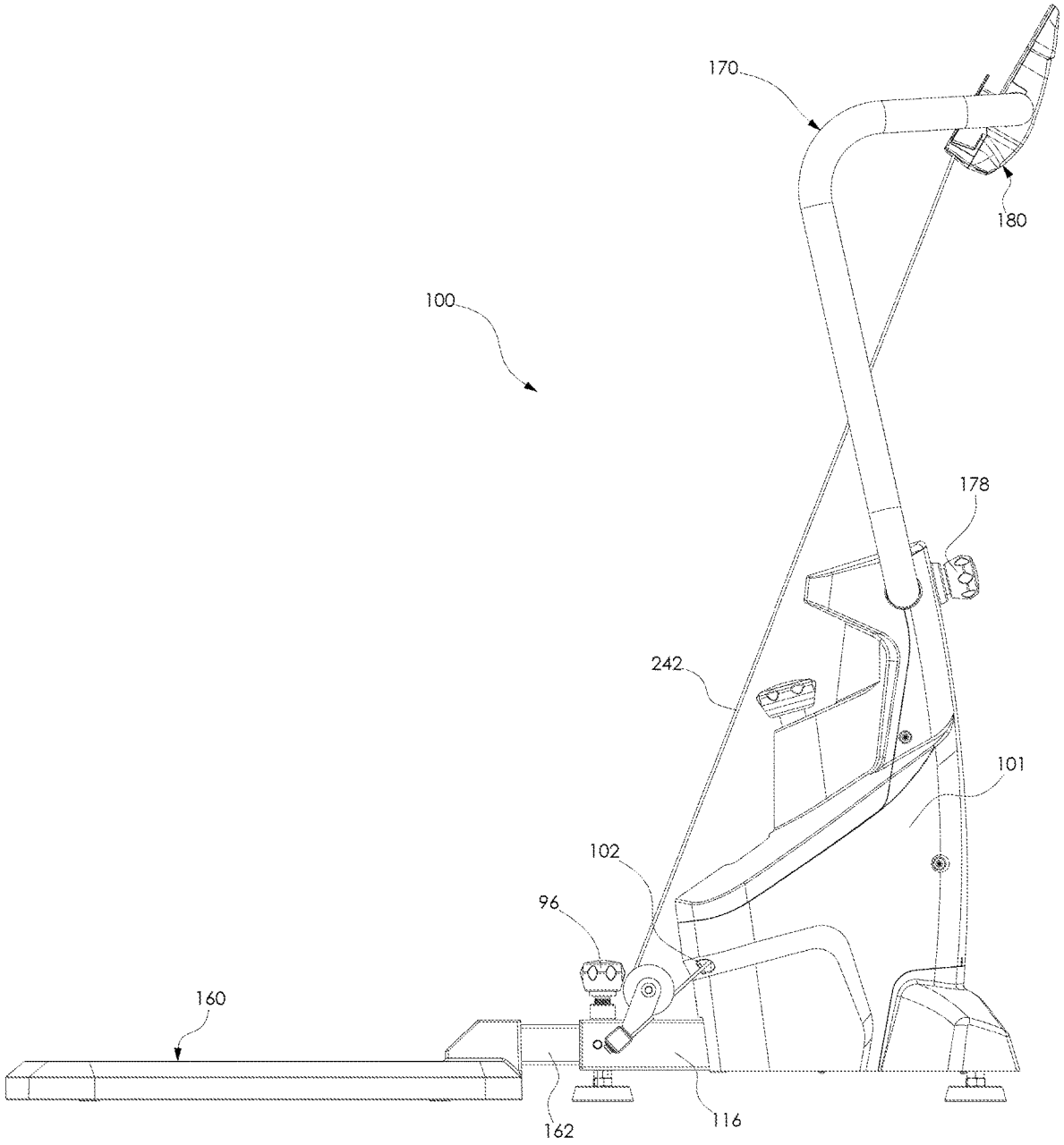
FIG. 5*b* is another right side view of the exercise apparatus shown in FIG. 1, showing a cord routed to an alternative location.
Figure 5C:
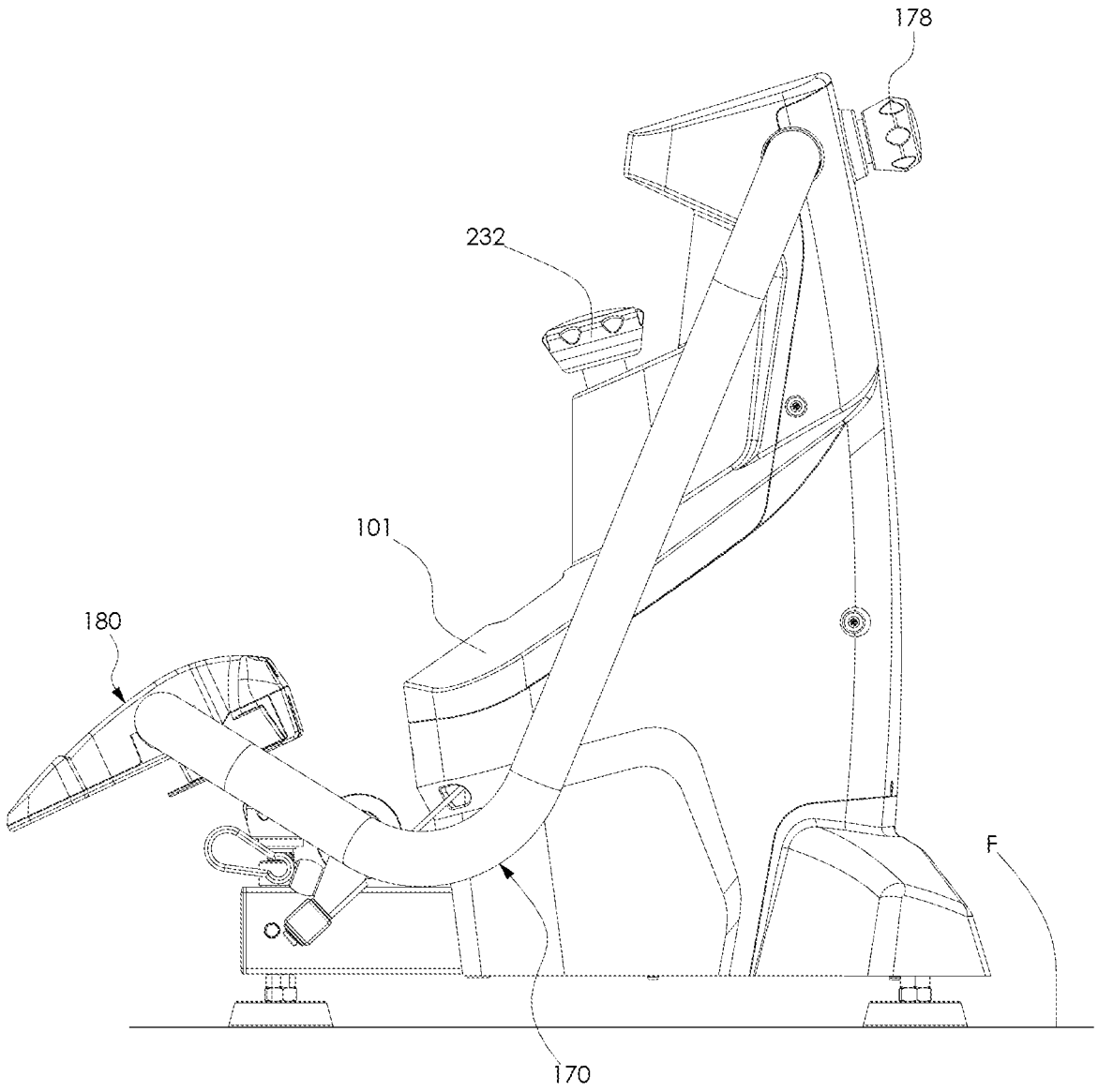
FIG. 5*c* is another right side view of the exercise apparatus shown in FIG. 1, showing a handlebar rotated to a storage orientation and a foot platform removed from the apparatus.

A foot support 160 is selectively and adjustably connected to the frame 110. In this regard, a foot support member or connector 162 has a forward end that telescopes into the central frame member 116. A fastener 96 of a type known in the art extends through a hole in the central frame member 116 and an aligned one of several holes 164 in the foot connector member 162. An opposite, rear end of the foot connector member 162 is rigidly secured to a plastic foot platform 166, both directly and via a metal framework of reinforcement members. The foot platform 166 defines a textured, upwardly facing foot supporting surface that is sized and configured to receive and support both feet of a person in a standing position. Consistent with the feet 98, the foot support 160 is configured to occupy a stable operating position relative to the underlying floor surface F. For storage and/or transportation purposes, the foot connector member 162 may be pulled out of the central frame member 116 to free the foot support 160 from the base 110, thereby significantly decreasing the footprint of the apparatus 100, as shown in FIG. 5*c*.

Figure 8:
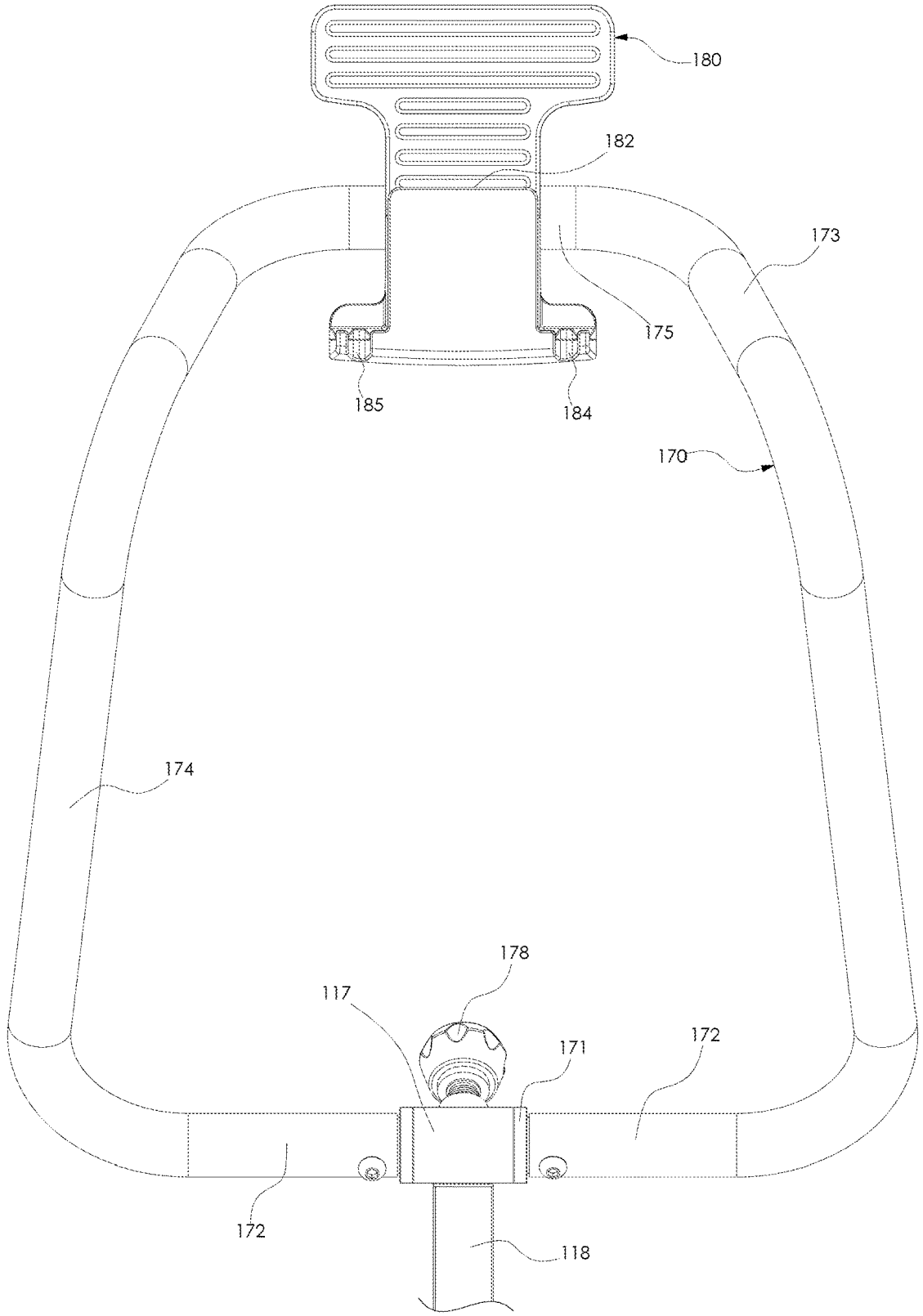
FIG. 8 is a nearly rear view of a handle bar assembly of the exercise apparatus of FIG. 1, with the assembly angled thirty degrees from vertical to present a true plan view of a console component of the handlebar assembly.
Figure 9:
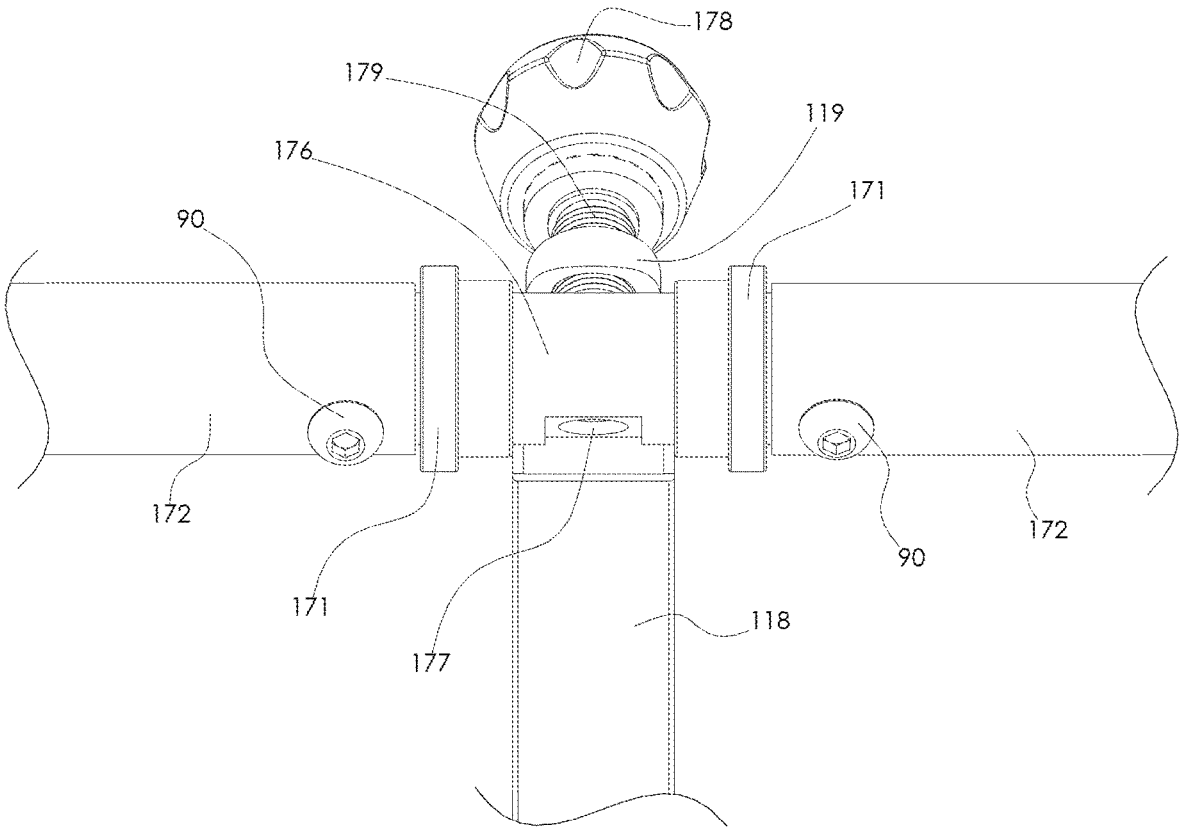
FIG. 9 is a nearly rear view of an enlarged lower portion of the handle bar assembly of FIG. 1, with the lower portion angled the same thirty degrees from vertical and with an exterior part removed to reveal certain interior features.

A front post or frame member 118 is rigidly connected to a forward end of the central frame member 116. Within the confines of the housing 101, the post 118 extends primarily upward away from the floor surface F to support a handlebar 170. FIGS. 8-9 shows the elements of the post 118 and the handlebar 170 in the absence of the housing 101. As shown in FIG. 8, a cylindrical tube or sleeve 117 is rigidly connected (e.g. welded) to an upper end of the post 118 to rotatably support the handlebar 170. A nut 119 (shown in FIG. 9) has internal threads and is welded onto the sleeve 117 (which is not shown in FIG. 9) in alignment with a hole in the sleeve 177.

As shown in FIG. 9, the handlebar 170 includes a solid cylindrical bar 176 that is interconnected between left and right horizontal handlebar segments or cylindrical tubes 172 (via screws 90). Respective ends of the bar 176 extend through left and right bushings 171, which are trapped between the ends of the sleeve 117 and the opposing ends of respective handlebar segments 172. The left and right bushings 171 keep the handlebar 170 centered relative to the sleeve 117 and accommodate rotation of the bar 176 inside the sleeve 117.

Two threaded holes extend into the bar 176, one of which is designated as 177 in FIG. 9, and the other of which is aligned with the nut 119 in FIG. 9. A fastener 178 has a shaft with external threads that mate with the threads in the nut 119 and the threads in the bar 176. When the fastener 178 is threaded into the bar 176 as arranged in FIG. 9, the fastener 178 holds the handlebar 170 in the operative or deployed orientation shown in FIG. 5*a* (and FIGS. 1-4, as well). When the fastener 178 is threaded out of the bar 176, the handlebar 170 is rotatable relative to the sleeve 117. When the hole 177 is rotated into alignment with the nut 119 and the fastener 178, the fastener 178 is threaded into the bar 176 to hold the handlebar 170 in the storage orientation shown in FIG. 5*c*.

Like much of the apparatus 100, the handlebar 170 is preferably symmetrical about a vertical plane extending through the center of the bar 176 (and the center of the post 118). The handlebar includes left and right substantially horizontal handlebar segments or cylindrical tubes 173, which are disposed at a higher, doubled elevation than the segments 172, and which extend perpendicular to the segments 172. Substantially vertical left and right handlebar segments or cylindrical tubes 173 are integrally interconnected between respective segments 173 and 172 via arcuate transition members or curved cylindrical tubes (shown but not numbered). The term "substantially" shall be interpreted to mean within 20 degrees of the referenced attribute (as in within 20 degrees of vertical or within 20 degrees of horizontal).

The handlebar 170 includes a centrally located horizontal segment 175 that is integrally interconnected between proximate ends of respective segments 173 via arcuate transition members or curved cylindrical tubes (shown but not numbered). As a result, the handlebar 170 cooperates with the bar 176 to formed a closed loop curve.

A console 180 is rigidly secured to the middle of the handlebar segment 175. The console is an assembly of injection molded plastic pieces sized and configured to hold various items. For example, the console 180 defines a recess 182 wherein a person can set a booklet or a cell phone. Also, the console 180 defines right and left notches or openings 184 and 185 to accommodate respective left and right cords 242 and 252 and hold in place respective carabiners 99. As shown in FIG. 5*b*, the cord 242 extends from the swivel pulley 142 to the console 180, where the cord 242 occupies the opening 184 and the carabiner 99 rests on top of the structure surrounding the opening 184. This arrangement provides an alternative storage location for the carabiners 99, the other being adjacent to the pulleys 142 and 152. FIG. 5*b* also shows an opening 102 in the shroud 101 to accommodate passage of the left cord 242 from the left pulley 142 to the left sheave inside the shroud 101. On the opposite side of the apparatus 100, a similar opening interrupts the shroud 101 to accommodate passage of the right cord 252 from the right pulley 152 to the right sheave inside the shroud 101.

Figure 6:
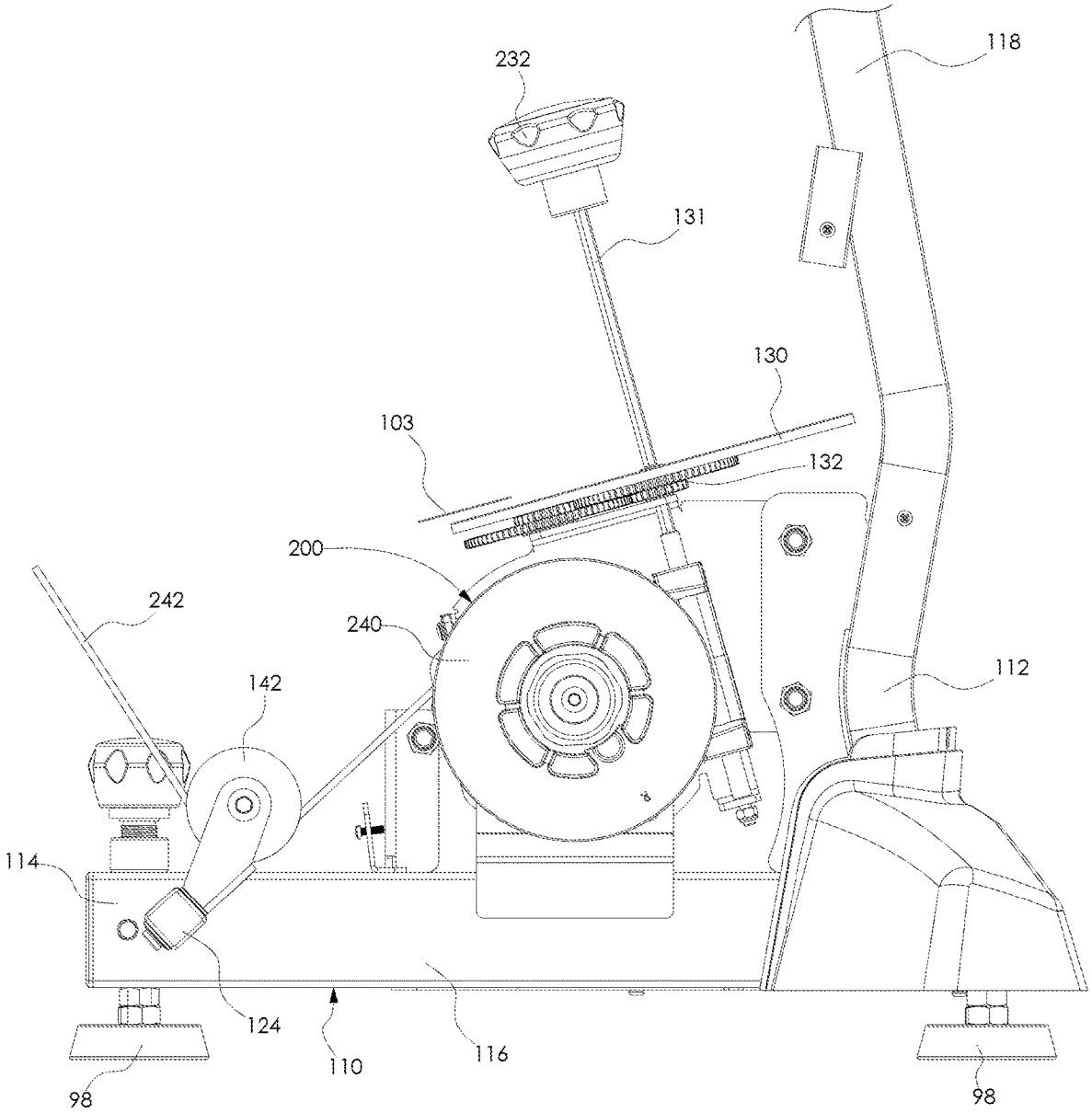
FIG. 6 is a side view of part of the exercise apparatus of FIG. 5 with some exterior parts removed to reveal certain interior parts.
Figure 7:
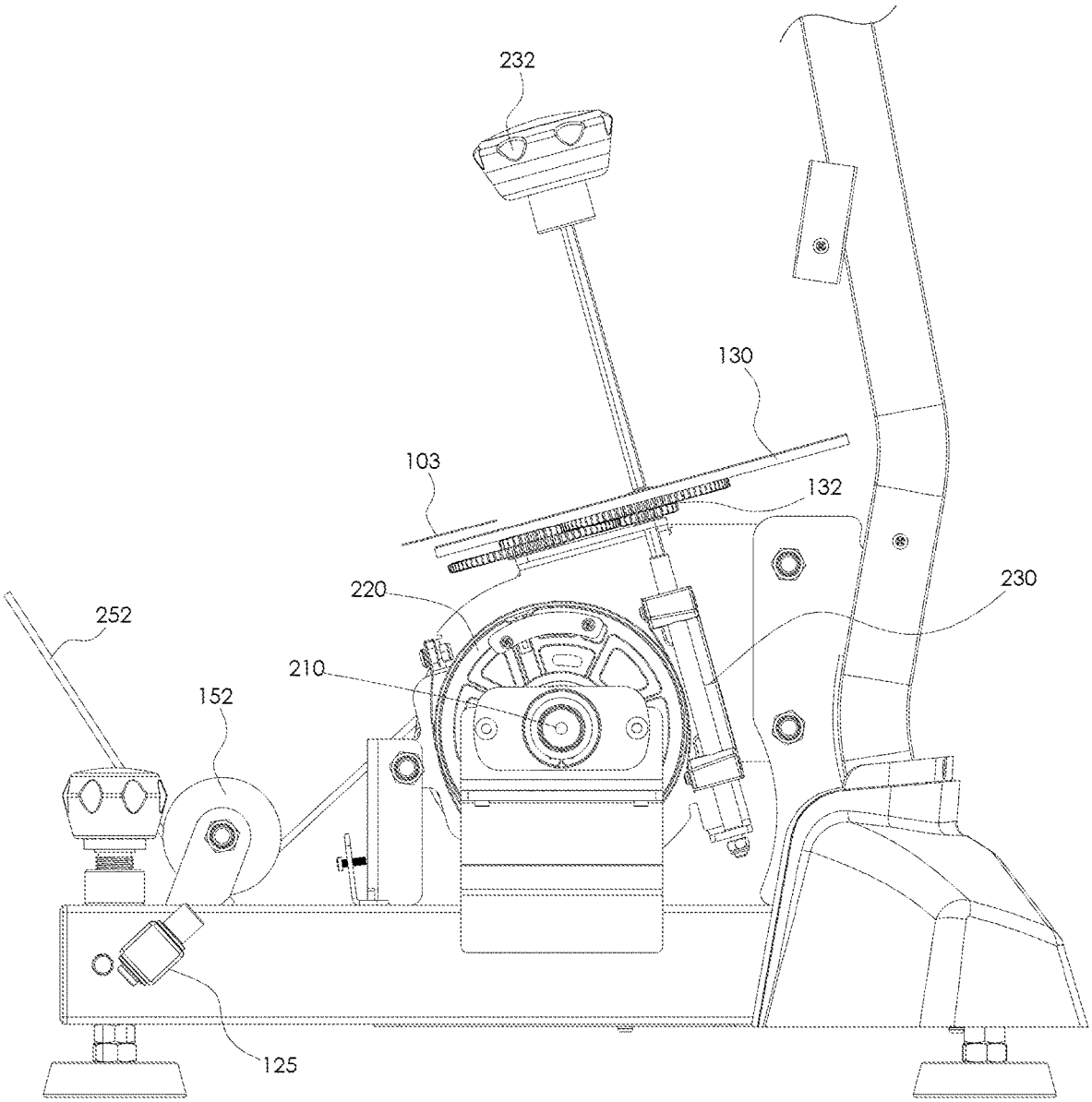
FIG. 7 is a side view of the exercise apparatus of FIG. 6 with some interior parts removed to reveal other interior parts.

The housing 101 includes a member 103 that defines a centrally located upwardly opening window. The member 103 overlies part of a large disc 130, and aligns with numbers disposed on the disc 130. With reference to FIG. 6, the disc 130 is rotatably mounted on a shaft 131, which may be described as an extension of the adjustment bolt on the resistance device 200, and more specifically, the adjustable brake assembly 230 that is a sub-assembly of the resistance device 200. In other words, the shaft 131 is coaxially aligned with the adjustment bolt and rigidly secured thereto. The adjustment knob 232 is rigidly secured to the upper distal end of the shaft 131. A gear assembly 132 includes a relatively smaller diameter gear keyed to the shaft 131. This smaller gear mates with a first portion of an intermediate gear that is rotatably mounted on the frame 110. A second portion of this intermediate gear mates with a relatively larger gear that is integrally connected to the disc 130. In a manner known in the art, the diameters of the two portions of the intermediate gear are optimized to rotate the disc 130 through a desired range of rotations in response to multiple rotations of the adjustment knob 232 through a desired range of resistance settings. An appropriate one of the numbers on the disc 130 appears through the member 103 to indicate the current resistance setting. The disc 130 may be described as having a diameter at least as large as the diameter of the sheave 240 and/or the diameter of the brake drum 220.

In use, a person stands with at least one foot on the foot platform 160 and pulls at least one carabiner 99 away from a respective pulley 142 or 152. The carabiner 99 may be considered a force receiving member, but preferably is clipped to a more suitable force receiving member, examples of which are known in the art and/or disclosed in the incorporated references. The person may perform some exercises with her toes pointed toward the console 180, others with her toes pointed in an opposite direction, away from the console 180, and others with her toes facing left or right. In some instances, especially when exercising a single arm and/or a single leg, the person may brace herself by grasping some portion(s) of the handlebar 170 in one or both hands. The person may reposition the foot platform 160 relative to the base 110 by loosening the fastener 96, sliding more or less of the connector 162 into the central frame member 116, and tightening the fastener 96 with holes in the connector 162 and the central frame member 116 aligned. The person may adjust resistance to exercise by rotating the knob 232 clockwise to increase resistance or counter-clockwise to decrease resistance. The person may choose to adjust until a particular number appears in the window member 103 or until the resistance feels appropriate. The person may elect to place her cell phone on the console to provide entertainment and/or exercise information during exercise. The person may elect to temporarily store one or both carabiners 99 on the console 180 to place them within reach while standing upright on the foot platform 160.

An embodiment exercise apparatus comprises a base, a sheave, a rewind mechanism, a cord, a force receiving member, a pulley bracket, and a pulley. The base is configured to occupy a stable operating position on an underlying horizontal floor surface. The sheave is rotatably mounted on the base for rotation about a fixed sheave axis, wherein the sheave defines a circumferential groove. The rewind mechanism is interconnected between the sheave and the base, wherein the rewind mechanism biases the sheave in a rewinding direction relative to the base. The cord has a first end, an opposite, second end, and cord segments disposed therebetween, wherein the first end is secured to the sheave, and at least one of the cord segments is wrapped around the sheave inside the groove. The force receiving member is operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in the opposite, cord rewinding direction. The pulley bracket is rotatably mounted on the base for rotation about a fixed bracket axis. The pulley is rotatably mounted on the pulley bracket for rotation about a pulley axis, wherein the pulley defines a circumferential groove to receive and reroute at least one of the cord segments, and as an extracted one of the cord segments is pulled linearly from the sheave to the pulley, the bracket axis axially aligns with said extracted one of the cord segments.

The base may include a housing that defines an opening, and the sheave may be disposed inside the housing, and the pulley may be disposed outside the housing, and said extracted one of the cord segments may extend through the opening from the sheave to the pulley.

The pulley bracket may be disposed at a first elevation about the floor surface, and the sheave axis may be disposed at a relatively greater, second elevation above the floor surface.

The base may define a front end and a rear end, and a foot platform may be connected to the rear end and configured and arranged to occupy a stable position relative to the underlying floor surface.

The pulley bracket may be disposed rearward of the sheave axis and forward of the foot platform.

The base may define a front end and a rear end, and a foot platform may be connected to the rear end and configured and arranged to occupy a stable position relative to the underlying floor surface.

The foot platform may be telescopically connected to the base for selective movement forward and backward relative to the base.

The pulley bracket may be disposed rearward of the sheave axis and forward of the foot platform.

The foot platform may be selectively removable from the base to make the exercise apparatus more compact for storage purposes.

A fastener may extend downward through overlapping portions of the foot platform and the base to selectively secure the foot platform in place relative to the base.

The bracket axis may define an angle of forty-five degrees relative to the floor surface.

A brake member may be rotatably mounted on the base for rotation about the sheave axis, wherein the sheave may be linked to the brake drum in a manner that constrains the brake drum to rotate with the sheave in the cord extracting direction and allows the sheave to rotate relative to the brake drum in the cord rewinding direction.

A resistance adjustment mechanism may be connected to the brake member and a resistance display may be connected to the resistance adjustment mechanism, wherein resistance display displays different indicia as a function of how the adjustment mechanism is currently set.

The resistance display may include a circular disc having a disc diameter, and the sheave may define a sheave diameter that is less than the disc diameter.

The resistance display may include a circular disc having a disc diameter and the brake member may define a brake diameter that is less than the disc diameter.

A right said sheave may be rotatably mounted on the base for rotation about the sheave axis, and a left said sheave may be rotatably mounted on the base for rotation about the sheave axis; and a right said rewind mechanism may be interconnected between the right said sheave and the base, and a left said rewind mechanism may be interconnected between the left said sheave and the base; and a right said cord may have its first said end secured to the right said sheave, and a left said cord may have its first end secured to the left said sheave; and a right said force receiving member may be connected to the second end of the right said cord, and a left said force receiving member may be connected to the second end of the left said cord; and a right said pulley bracket may be rotatably mounted on the base for rotation about a right said bracket axis, and a left said pulley bracket may be rotatably mounted on the base for rotation about a left said bracket axis; and a right said pulley may be rotatably mounted on the right said pulley bracket for rotation about a right pulley axis, and a left said pulley may be rotatably mounted on the left said pulley bracket for rotation about a left pulley axis.

A handlebar may be rotatably mounted on the base for selective rotation between a deployed orientation, extending generally vertically upward from the base, and a storage orientation, wherein all of the handlebar is disposed beneath an uppermost portion of the base.

A handlebar may be mounted on the base, wherein the second end of the cord is selectively held in place relative to the handlebar.

An embodiment exercise apparatus comprises a base, a sheave, a rewind mechanism, a cord, a force receiving member, a cord routing member, and a retainer. The base is configured to occupy a stable operating position on an underlying horizontal floor surface. The sheave is rotatably mounted on the base for rotation about a sheave axis, wherein the sheave defines a circumferential groove. The rewind mechanism is interconnected between the sheave and the base, wherein the rewind mechanism biases the sheave in a rewinding direction relative to the base. The cord has a first end, an opposite, second end, and cord segments disposed therebetween, wherein the first end is secured to the sheave, and at least one of the cord segments is disposed inside the groove and wrapped around the sheave. The force receiving member is operatively connected to the second end of the cord, wherein movement of the force receiving member in a first exercise direction is linked to rotation of both the sheave and the drum in a cord extracting direction, and movement of the force receiving member in an opposite, second exercise direction accommodates rotation of the sheave in the opposite, cord rewinding direction. The cord routing member is connected to the base at a first elevation above the floor surface, wherein the cord routing member defines a circumferential groove to receive and reroute at least one of the cord segments. The retainer is connected to the base at a relatively higher, second elevation above the floor surface, wherein the retainer is configured to releasably hold the force receiving member in a ready position at the higher elevation above the floor surface.

The retainer may define a horizontally accessible slot configured to receive a distal one of the cord segments, wherein said distal one of the cord segments may be adjacent the second end of the cord.

The retainer may hold the second end of the cord within arm's reach of a person standing upright adjacent to the base.

A right said sheave may be rotatably mounted on the base for rotation about the sheave axis, and a left said sheave may be rotatably mounted on the base for rotation about the sheave axis; and a right said rewind mechanism may be interconnected between the right said sheave and the base, and a left said rewind mechanism may be interconnected between the left said sheave and the base; and a right said cord may have its first said end secured to the right said sheave, and a left said cord may have its first end secured to the left said sheave; and a right said force receiving member may be connected to the second end of the right said cord, and a left said force receiving member may be connected to the second end of the left said cord.

The retainer may define a left horizontally accessible slot to hold the second end of the left cord within arm's reach of a person standing upright adjacent to the base, and the retainer may define a right horizontally accessible slot to hold the second end of the right cord within arm's reach of a person standing upright adjacent to the base.

The retainer may define a centrally located cell phone receptacle between the left slot and the right slot.

An embodiment exercise apparatus comprises a base, a sheave, a rewind mechanism, a cord, a force receiving member, and a handlebar. The base is configured to occupy a stable operating position on an underlying horizontal floor surface. The sheave is rotatably mounted on the base for rotation about a sheave axis, wherein the sheave defines a circumferential groove. The rewind mechanism is interconnected between the sheave and the base, wherein the rewind mechanism biases the sheave in a rewinding direction relative to the base. The cord has a first end, an opposite, second end, and at least one cord segment disposed therebetween, wherein the first end is secured to the sheave, and at least one said cord segment is wrapped around the sheave inside the groove. The force receiving member is connected to the second end of the cord, wherein movement of the force receiving member in a first exercise direction is linked to rotation of the sheave in a cord extracting direction, and movement of the force receiving member in an opposite, second exercise direction accommodates rotation of the sheave in the opposite, cord rewinding direction. The handlebar has a first handlebar segment, a second handlebar segment and a third handlebar segment, wherein the first handlebar segment is connected to the base at a first elevation above the floor surface, and the third handlebar segment is disposed at a relatively greater, second elevation above the floor surface, and the second handlebar segment is rigidly interconnected between the first handlebar segment and the third handlebar segment, and each said handlebar segment defines at least one handgrip sized and configured to be grasped extend laterally through opposite sides of a person's fist.

The second elevation may be double the first elevation.

The first handlebar segment and the third handlebar segment may extend substantially parallel to the floor surface.

The second handlebar segment may be L-shaped.

A forwardmost edge of the console may be further forward than a forwardmost edge of the base.

A forwardmost edge of the handlebar may be further forward than a forwardmost edge of the base.

The handlebar may be selectively rotatably mounted on the base for rotation between a deployed orientation, extending generally vertically upward from the base, and a storage orientation, wherein the handlebar may be entirely beneath an uppermost portion of the base.

A cord routing member may be connected to the base at a relatively lower, third elevation above the floor surface, wherein the cord routing member may define a circumferential groove to receive and reroute at least one of the cord segments.

The force receiving member may occupy a first rest position, proximate the cord routing member, when not in use.

The force receiving member may occupy an alternative, second rest position, proximate the third handlebar segment, when not in use.

The force receiving member may occupy a rest position, proximate the third handlebar segment, when not in use.

The subject invention has been described with reference to embodiments and particular applications with the understanding that features of the subject invention may be practiced individually and/or in various combinations and/or on various types of exercise equipment. Also, persons skilled in the art will recognize that various modifications may be made to the embodiments, in any of its applications, without departing from the scope of the subject invention. Furthermore, alternative embodiments may be made with different component materials, structures, and/or spatial relationships, and nonetheless fall within the scope of the present invention. In view of the foregoing, the subject invention should be limited only to the extent of allowable claims that issue from this application or any related application

What is claimed is:

1. An exercise apparatus, comprising:

a base configured to occupy a stable operating position on an underlying horizontal floor surface, wherein the base defines a front end and a rear end, and the exercise apparatus further comprises a foot platform connected to the rear end and configured and arranged to occupy the stable operating position relative to the underlying horizontal floor surface, wherein the foot platform is telescopically connected to the rear end of the base for selective movement forward and backward relative to the rear end of the base;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis; and a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments.

2. The exercise apparatus of claim 1, wherein the pulley bracket is disposed rearward of the fixed sheave axis and forward of the foot platform.

3. The exercise apparatus of claim 1, further comprising a brake member rotatably mounted on the base for rotation about the fixed sheave axis, wherein the sheave is linked to the brake member in a manner that constrains the brake member to rotate with the sheave in the cord extracting direction, and allows the sheave to rotate relative to the brake member in the cord rewinding direction.

4. The exercise apparatus of claim 3, further comprising a resistance adjustment mechanism connected to the brake member, and a resistance display connected to the resistance adjustment mechanism, wherein the resistance display displays different indicia as a function of how the resistance adjustment mechanism is currently set.

5. An exercise apparatus 6, comprising:

a base configured to occupy a stable operating position on an underlying horizontal floor surface, wherein the base defines a front end and a rear end, and the exercise apparatus further comprises a foot platform connected to the rear end and configured and arranged to occupy the stable operating position relative to the underlying horizontal floor surface, wherein the foot platform is selectively removeable from the rear end of the base to make the exercise apparatus more compact for storage purposes;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis; and a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments.

6. An exercise apparatus, comprising:

a base configured to occupy a stable operating position on an underlying horizontal floor surface, wherein the base defines a front end and a rear end, and the exercise apparatus further comprises a foot platform connected to the rear end and configured and arranged to occupy the stable operating position relative to the underlying horizontal floor surface, wherein a fastener extends downward through overlapping portions of the foot platform and a central frame member of the base to selectively secure the foot platform in place relative to the central frame member of the base;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, and opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis; and a pulley rotatably mounted on the pulley bracket for rotation about a pulley axis, wherein the pulley defines a pulley circumferential groove to receive a reroute at least one of the cord segments, wherein as an extracted one of the cord segments is pulled linearly from the sheave to the pulley, the fixed bracket axis aligns axially with said extracted one of the cord segments.

7. The exercise apparatus of claim 6, further comprising a brake member rotatably mounted on the base for rotation about the fixed sheave axis, wherein the sheave is linked to the brake member in a manner that constrains the brake member to rotate with the sheave in the cord extracting direction, and allows the sheave to rotate relative to the brake member in the cord rewinding direction.

8. The exercise apparatus of claim 7, further comprising a resistance adjustment mechanism connected to the brake member, and a resistance display connected to the resistance adjustment mechanism, wherein the resistance display displays different indicia as a function of how the resistance adjustment mechanism is currently set.

9. An exercise apparatus, comprising:

a base configured to occupy a stable operating position on an underlying horizontal floor surface;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis;

a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments;

a brake member rotatably mounted on the base for rotation about the fixed sheave axis, wherein the sheave is linked to the brake member in a manner that constrains the brake member to rotate with the sheave in the cord extracting direction, and allows the sheave to rotate relative to the brake member in the cord rewinding direction; and a resistance adjustment mechanism connected to the brake member, and a resistance display connected to the resistance adjustment mechanism, wherein the resistance display displays different indicia as a function of how the resistance adjustment mechanism is currently set, wherein the resistance display includes a circular disc having a disc diameter, and the sheave defines a sheave diameter that is less than the disc diameter.

10. An exercise apparatus, comprising:

a base configured to occupy a stable operating position on an underlying horizontal floor surface;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis;

a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments;

a brake member rotatably mounted on the base for rotation about the fixed sheave axis, wherein the sheave is linked to the brake member in a manner that constrains the brake member to rotate with the sheave in the cord extracting direction, and allows the sheave to rotate relative to the brake member in the cord rewinding direction; and a resistance adjustment mechanism connected to the brake member, and a resistance display connected to the resistance adjustment mechanism, wherein the resistance display displays different indicia as a function of how the resistance adjustment mechanism is currently set, wherein the resistance display includes a circular disc having a disc diameter, and the brake member defines a brake diameter that is less than the disc diameter.

11. An exercise apparatus, comprising:

a base configured to occupy a stable operating position on an underlying horizontal floor surface;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis;

a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments;

a brake member rotatably mounted on the base for rotation about the fixed sheave axis, wherein the sheave is linked to the brake member in a manner that constrains the brake member to rotate with the sheave in the cord extracting direction, and allows the sheave to rotate relative to the brake member in the cord rewinding direction; and a resistance adjustment mechanism connected to the brake member, and a resistance display connected to the resistance adjustment mechanism, wherein the resistance display displays different indicia as a function of how the resistance adjustment mechanism is currently set, wherein the resistance display includes at least a portion of a disc overlying at least a portion of the brake member and having an upwardly facing surface that bears the different indicia.

12. An exercise apparatus, comprising:

a base configured to occupy a stable operating position on an underlying horizontal floor surface;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis;

a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments;

a brake member rotatably mounted on the base for rotation about the fixed sheave axis, wherein the sheave is linked to the brake member in a manner that constrains the brake member to rotate with the sheave in the cord extracting direction, and allows the sheave to rotate relative to the brake member in the cord rewinding direction;

a resistance adjustment mechanism connected to the brake member, and a resistance display connected to the resistance adjustment mechanism, wherein the resistance display displays different indicia as a function of how the resistance adjustment mechanism is currently set; and an adjustment knob operatively connected to the resistance adjustment mechanism and rotatably mounted on the base for rotation about a knob axis, wherein the brake member is disposed above the underlying horizontal floor surface, and the resistance display is disposed above the brake member, and the adjustment knob is disposed above the resistance display.

13. The exercise apparatus of claim 12, wherein the base includes a housing that defines an opening, and the sheave is disposed inside the housing, and the pulley is disposed outside the housing, and said extracted one of the cord segments extends through the opening from the sheave to the pulley.

14. The exercise apparatus of claim 12, wherein the pulley bracket is disposed at a first elevation above the underlying horizontal floor surface, and the fixed sheave axis is disposed at a relatively greater, second elevation above the underlying horizontal floor surface.

15. The exercise apparatus of claim 14, wherein the base defines a front end and a rear end, and the exercise apparatus further comprises a foot platform connected to the rear end and configured and arranged to occupy the stable operating position relative to the underlying horizontal floor surface.

16. The exercise apparatus of claim 15, wherein the pulley bracket is disposed rearward of the fixed sheave axis and forward of the foot platform.

17. The exercise apparatus of claim 12, wherein the base defines a front end and a rear end, and the exercise apparatus further comprises a foot platform connected to the rear end and configured and arranged to occupy the stable operating position relative to the underlying horizontal floor surface.

18. The exercise apparatus of claim 12, wherein the fixed bracket axis defines an angle of forty-five degrees relative to the underlying, horizontal floor surface.

19. The exercise apparatus of claim 12, wherein:

the sheave comprises left and right sheaves, the left and right sheaves are rotatably mounted on the base for rotation about the fixed sheave axis;

the rewind mechanism comprises left and right rewind mechanisms, the left rewind mechanism is interconnected between the left sheave and the base, and the right rewind mechanism is interconnected between the right sheave and the base;

the cord comprises left and right cords, the left cord has a first end thereof secured to the left sheave, and the right cord has a first end thereof secured to the right sheave;

the force receiving member comprises left and right force receiving members, the left force receiving member is connected to a second end of the left cord, and the right force receiving member is connected to a second end of the right cord;

the pulley bracket for rotation about the fixed bracket axis comprises left and right pulley brackets for respective rotation about left and right fixed bracket axes, the left pulley bracket is rotatably mounted on the base for rotation about the left fixed bracket axis, and the right pulley bracket is rotatably mounted on the base for rotation about the right fixed bracket axis; and the pulley for rotation about the pulley axis comprises left and right pulleys for respective rotation about left and right pulley axes, the left pulley is rotatably mounted on the left pulley bracket for rotation about the left pulley axis, and the right pulley is rotatably mounted on the right pulley bracket for rotation about the right pulley axis.

20. The exercise apparatus of claim 12, further comprising a handlebar mounted on the base, wherein the second end of the cord is selectively held in place relative to the handlebar.

21. An exercise apparatus, comprising:

a base configured to occupy a stable operating position on an underlying horizontal floor surface;

a sheave rotatably mounted on the base for rotation about a fixed sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is wrapped around the sheave inside the sheave circumferential groove;

a force receiving member operatively connected to the second end of the cord, wherein movement of the force receiving member in a first exercise direction is linked to rotation of the sheave in a cord extracting direction, and movement of the force receiving member in an opposite, second exercise direction allows the rewind mechanism to rotate the sheave in an opposite, cord rewinding direction;

a pulley bracket rotatably mounted on the base for rotation about a fixed bracket axis;

a pulley rotatably mounted on the pulley bracket for rotation about a pulley axis, wherein the pulley defines a pulley circumferential groove to receive and reroute at least one of the cord segments, wherein as an extracted one of the cord segments is pulled linearly from the sheave to the pulley, the fixed bracket axis aligns axially with said extracted one of the cord segments; and a handlebar rotatably mounted on the base for selective rotation between a deployed orientation, extending generally vertically upward from the base, and a storage orientation, wherein all of the handlebar is disposed beneath an uppermost portion of the base.

22. An exercise apparatus, comprising:

a base configured to occupy a stable operating position on an underlying horizontal floor surface;

a sheave rotatably mounted on the base for rotation about a sheave axis, wherein the sheave defines a sheave circumferential groove;

a rewind mechanism interconnected between the sheave and the base, wherein the rewind mechanism biases the sheave in a rewinding direction relative to the base;

a cord having a first end, an opposite, second end, and cord segments disposed therebetween, wherein the first end is secured to the sheave, and at least one of the cord segments is disposed inside the sheave circumferential groove and wrapped around the sheave inside the sheave circumferential groove;

a force receiving member operatively connected to the second end of the cord, wherein movement of the force receiving member in a first exercise direction is linked to rotation of both the sheave and a drum in a cord extracting direction, and movement of the force receiving member in an opposite, second exercise direction accommodates rotation of the sheave in an opposite, cord rewinding direction;

a cord routing member connected to the base at a first elevation above the underlying, horizontal floor surface, wherein the cord routing member defines a cord routing circumferential groove to receive and reroute at least one of the cord segments;

a retainer connected to the base at a relatively higher, second elevation above the underlying horizontal floor surface, wherein the retainer is configured to releasably hold the force receiving member in a ready position at the relatively higher, second elevation above the underlying horizontal floor surface; and a handlebar having a first handlebar segment, a second handlebar segment and a third handlebar segment, wherein the first handlebar segment is connected to the base at a first handlebar elevation above the underlying horizontal floor surface, and the third handlebar segment is disposed at a relatively greater, second handlebar elevation above the underlying horizontal floor surface, and the second handlebar segment is rigidly interconnected between the first handlebar segment and the third handlebar segment, and each said handlebar segment defines at least one handgrip sized and configured to be grasped while extending laterally through opposite sides of a person's fist, wherein the handlebar is rotatably mounted on the base for selective rotation between a deployed orientation, wherein the handlebar extends generally vertically upward from the base, and a storage orientation, wherein the handlebar is entirely beneath an uppermost portion of the base.

23. The exercise apparatus of claim 22, wherein the retainer is mounted on the third handlebar segment.

24. The exercise apparatus of claim 22, wherein the retainer defines a cell phone receptacle.

* * * * *